United States Patent [19]

Alenares

[11] 4,099,522

[45] Jul. 11, 1978

[54] HYDROTHERAPY APPARATUS AND METHOD FOR EXERCISING THE VEINS OF THE LEG AND FOOT

[76] Inventor: Santiago S. Alenares, 3038 SW. 8th St., Apt. B202, Miami, Fla. 33135

[21] Appl. No.: 790,850

[22] Filed: Apr. 25, 1977

[51] Int. Cl.[2] ..... A61H 9/00

[52] U.S. Cl. ..... 128/66; 128/370

[58] Field of Search ..... 128/66, 366, 370, 25 B; 4/165, 182

[56] References Cited

U.S. PATENT DOCUMENTS

| | | | |
|---|---|---|---|
| 847,324 | 3/1907 | Ely | 128/370 |
| 1,733,054 | 10/1929 | Crill | 128/366 |
| 1,775,442 | 9/1930 | Sarason | 128/370 |
| 2,272,481 | 2/1942 | Rinkes et al. | 128/66 |
| 2,730,104 | 1/1956 | Newman | 128/370 |
| 2,949,109 | 8/1960 | Koolnis | 128/66 |
| 3,027,568 | 4/1962 | Blau et al. | 4/182 |
| 3,458,874 | 8/1969 | Fritz | 128/366 |
| 3,827,087 | 8/1974 | Cuthpertson | 128/370 |

*Primary Examiner*—Lawrence W. Trapp
*Attorney, Agent, or Firm*—Erwin M. Barnett

[57] ABSTRACT

An apparatus and method for exercising the smooth muscles of the superficial veins of the legs and feet provide for supporting the patient in a reclining supine position with legs held horizontally in a relaxed condition over a water collecting pan. Surface areas of each foot and calf are subjected to predetermined contrasting temperatures in prescribed sequence and time intervals by means of water sprayed from nozzles onto the surface areas. The water temperature is monitored by temperature gauge means and is operator controlled by a mixing valve having a capability of delivering temperatures varying from a maximum of about 45° C to a minimum of about 21° C from conventional building hot and cold water supply sources. Adjustable means supports the nozzles to accommodate the normal range of leg lengths diametric sizes.

11 Claims, 6 Drawing Figures

HYDROTHERAPY APPARATUS AND METHOD FOR EXERCISING THE VEINS OF THE LEG AND FOOT

BACKGROUND OF THE INVENTION

1. Field of the Invention

This invention generally relates to a method of improving the tone of the smooth muscles of the superficial veins of the leg and foot and to an instrumentality for use in performing such method, and more particularly is directed to utilizing contrasting water temperature changes applied to the skin of the areas involved in a specific manner to induce timed smooth muscle contraction and relaxation.

2. Description of the prior art

It is well recognized that exercise is indicated as a corrective measure for poor muscle tone for smooth as well as skeletal muscles. Yet smooth muscles, not being under voluntary control, require an indirect approach to effect contraction as compared to skeletal muscles which are under the direct control of the patient's will. It is also known that a precursor of varicose veins of the leg and foot is excessive dilatation of these veins which is attributable in part to the loss of tone of the smooth muscles in the walls of the veins. It will, therefore, follow that exercising the smooth muscles of these veins will improve the muscle tone and aid in correcting a condition of excessive dilatation.

It has also been known that the superficial veins which are under control of the sympathetic and parasympathic nervous systems respond to an environmental lowering of temperature applied to the skin by constriction, which is effected by contraction of the smooth muscles in the walls of the veins, and to a raising of temperature by dilation, which is effected by a relaxation of the smooth muscles involved. The peripheral veins are also known to regulate the escape of heat from the surface of the body.

Although a need exists for a procedure to reduce the excessive dilatation of the superficial veins of the leg and foot as a means for impeding the development of varicose veins, nothing in physiotherapy is devoted to this problem. Currently used balneological equipment and methods which may be considered remotely pertinent hereto are directed to body immersion at constant temperatures to produce general relaxation of the skeletal muscles and dilation of the superficial vessels as well as for whirlpool massage. Jets of water are also used for body massage and to produce a general feeling of relaxation and well being. Contrast baths for alternate immersion of the body limbs in hot and cold water have been suggested for various vascular reactions but fail to achieve satisfactory results.

SUMMARY OF THE INVENTION

Among the objects of the invention is to provide an apparatus and method whereby the smooth muscles of the superficial veins of the leg and foot are exercised, that is, contracted and relaxed, under controlled conditions of time and position of the limbs to improve the muscle tone thereof. The apparatus shall comprise few and simple parts, many being standard and readily available for assembly as a relatively low cost unit and shall provide for the comfort of the patient and enable a therapist to perform the method with ease and efficiency.

The method is performed on a patient lying in supine position with legs suspended horizontally in a slightly spread position on supports located above the knee and at the heel. Sprays of water are directed against opposite sides of each foot and calf at an initial temperature of 37° C and gradually raised in 30 seconds to 45° C and maintained for 3 minutes. The water temperature is then lowered gradually in a 1 minute interval to 21° C and maintained for 3 minutes. Thereafter, a second cycle of hot and cold is applied by gradually returning in a 1 minute interval to 45° C, maintaining that temperature for 3 minutes and then reducing the temperature in a 1 minute interval to 21° C where it is maintained for another 3 minutes to complete one session of the therapy.

The apparatus provides a horizontal surface sized for a patient to lie in a supine relaxed position with legs outstretched and extending over a water collecting pan connected to a drain facility. Rest surface means, associated with the pan and being adjustable to accommodate differences in the length of patients' legs, support each leg in an outstretched, relaxed, slightly divergent, horizontal position in alignment with the body by contacting the underside of each thigh and each heel, each leg otherwise being freely suspended between the thigh and heel. Eight spray nozzles, each connected to a water conduit, are supported to simultaneously direct sprays of water to desired areas on opposite sides of each foot and calf. Temperature sensing means, including a gauge positioned for convenient observation by an operator of the apparatus, is located wthin the conduit for monitoring the spray temperature. The water conduits are connected to conventional hot and cold water sources through an interposed mixing valve for varying the temperature of the spray by manual operating means, preferably indexed and located for convenient manipulation by the operator while observing the water temperature gauge in performing the therapy as hereinbefore described or therapy similar thereto.

DESCRIPTION OF THE PREFERRED EMBODIMENT

Figure 1:
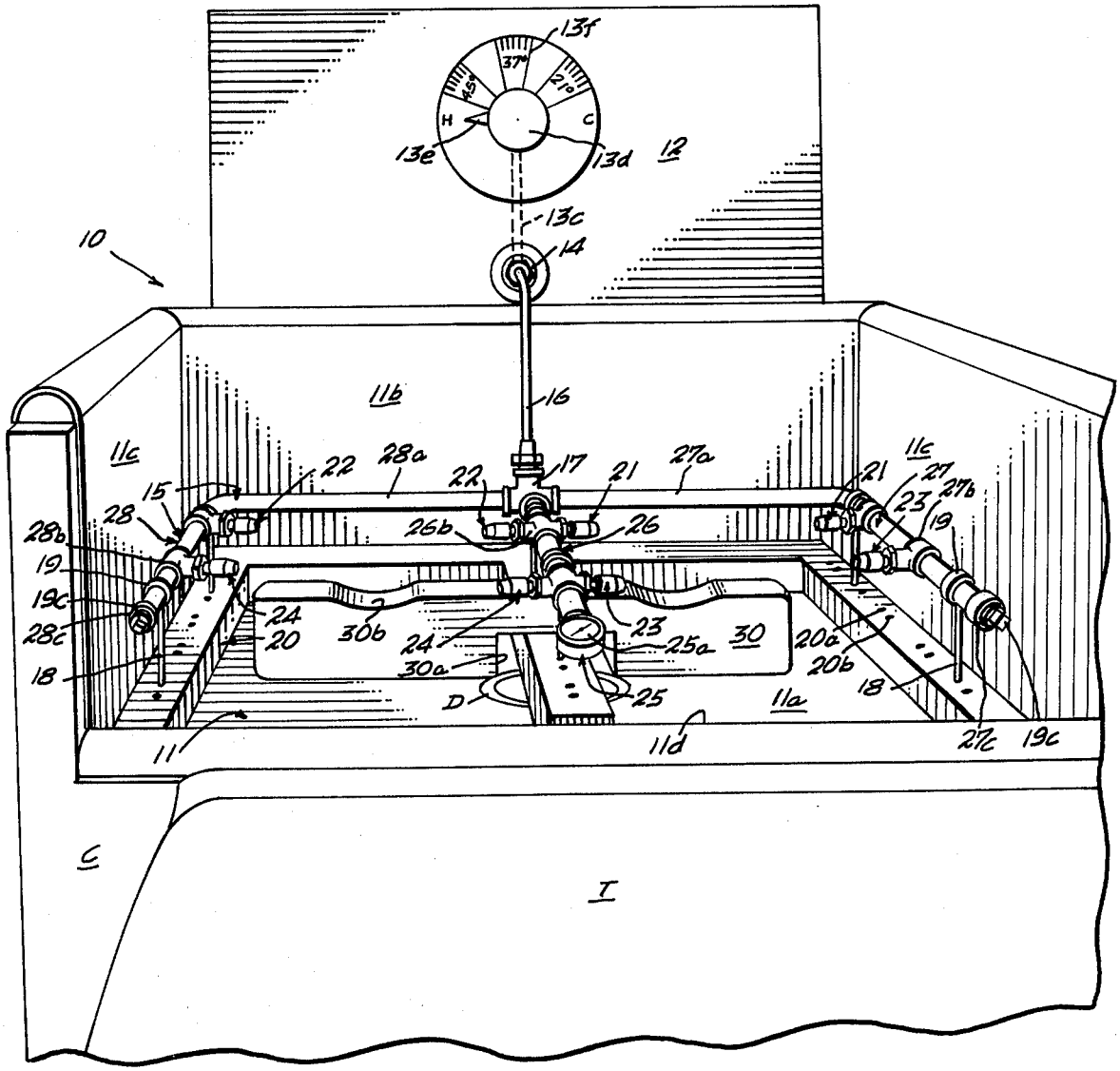
FIG. 1 is a front perspective view of the hydrotherapy apparatus embodying the invention showing the patient's table in position with respect to the front wall of the water collecting pan.

Referring in detail to the drawings, 10 generally denotes a hydrotherapy apparatus used in cooperation with a table T and comprising a water collecting pan or sink 11, a plumbing panel 12 mounting a hot and cold water mixing valve 13, a water spray assembly or harness 15 which is located within sink 11 and supports, and supplies water from mixing valve 13 to, four pairs of opposed nozzles 21, 22, 23 and 24 to provide a water spray in a predetermined pattern, and a thermometer 25 for monitoring the temperature of the water in harness 15.

Water collecting pan or sink 11 may be mounted for mobility on the top of a wheeled cabinet C, or as a wall mounted permanent installation, and is seen to comprise a bottom 11*a*, a vertical rear wall 11*b*, opposite vertical side walls 11*c* and a vertical front wall 11*d*. Rear wall 11*b* and side walls 11*c* may be any suitable height above bottom 11*a* to minimize splashing of the spray beyond the confines of sink 11. Plumbing panel 12 may extend vertically above and behind rear wall 11*a* and also mounts the plumbing associated with mixing valve 13, such as, inlet pipes 13*a* and 13*b* for connecting to hot and cold water supply lines, respectively, of the building, and outlet pipe 13*c* connecting the output from mixing valve 13 to fitting 14 from which connection is made to harness 15 by conduit 16.

Harness 15 comprises three parallel, coplanar, uniformly spaced branches which emanate from a 4-way coupling 17 located at the inner end of the middle branch 26. Right branch 27 and left branch 28 are connected to opposite ports of coupling 17 by right angular shaped conduits 27*a* and 28*a*, respectively. The fourth port of coupling 17 connects to conduit 16.

Figure 2:
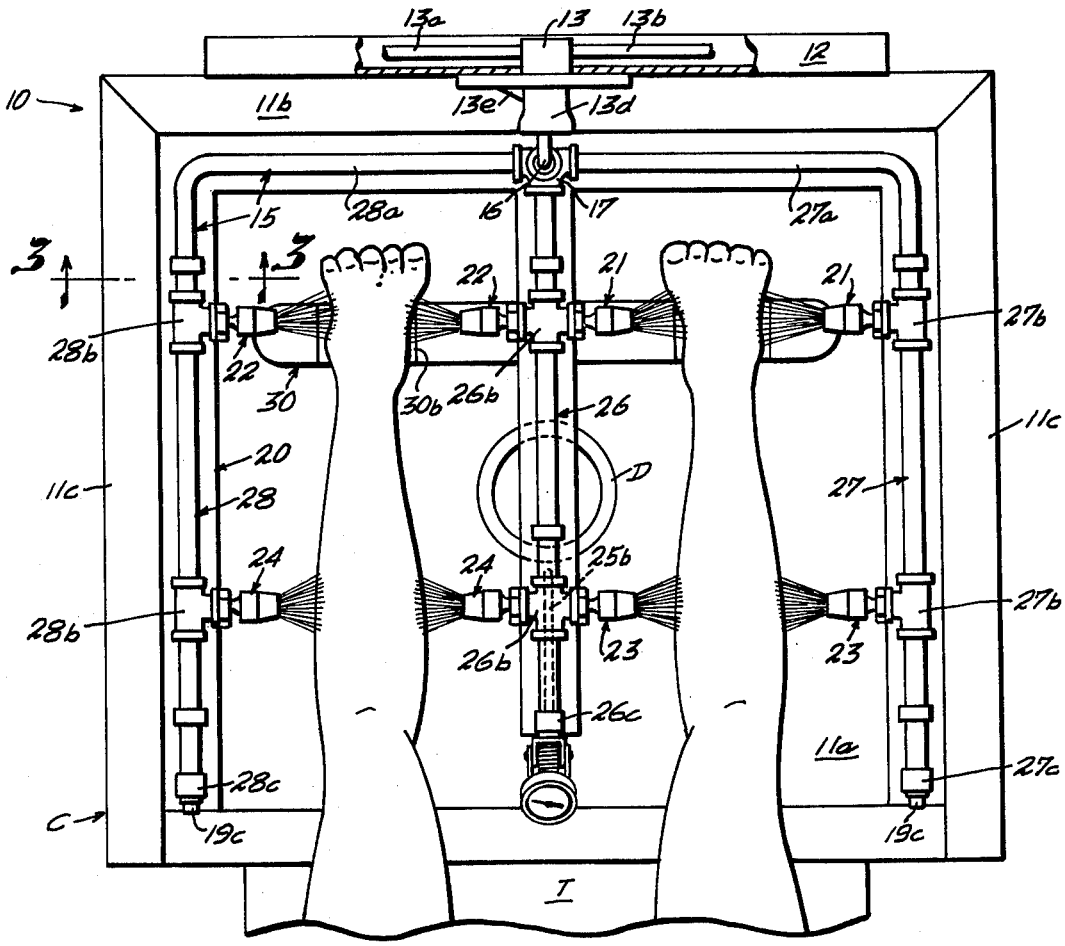
FIG. 2 is a top plan view of the apparatus shown in FIG. 1, a patient's legs being shown in horizontal position and receiving the water spray from the nozzles.
Figure 3:
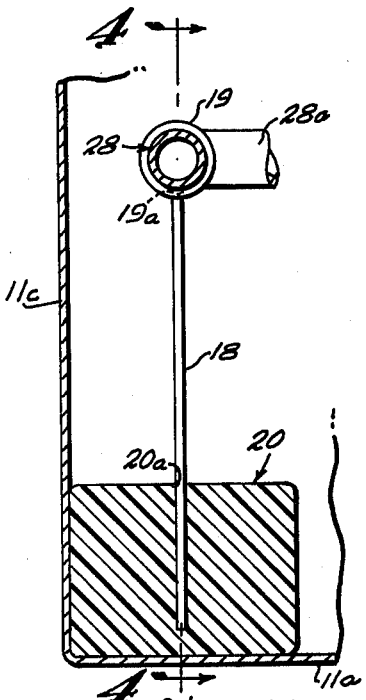
FIG. 3 is an enlarged fragmentary vertical section taken on line 3—3 in FIG. 2 showing details of the base, rod and collar which support the water spray assembly.

Right and left branches 27 and 28 of harness 15 each has a pair of spaced T-couplings 27*b* and 28*b*, respectively, which mount one of the nozzles of the four pairs 21, 22, 23 and 24 in a right angular relation to the respective branch. The companion nozzle of each pair is mounted on one of the ports of a pair of spaced 4-way couplings 26*b* provided along middle branch 26 and aligned with T-couplings 27*b* and 28*b*. As seen in FIG. 2, nozzle pairs 21 and 22 are located toward the rear of sink 11 to direct a spray at the patient's right and left foot, respectively, and nozzle pairs 23 and 24 are located toward the front of sink 11 to direct a spray at the right and left calf, respectively.

The forward or closed end of branches 26, 27 and 28 each has a coupling 26*c*, 27*c* and 28*c*, respectively, internally threaded to receive therein as an end closure a threaded plug 19*c* or thermometer 25 which is shown mounted on middle branch 26. Thermometer 25 may be of standard construction having a gauge dial 25*a* on a swivel mount for easy reading from various directions and has a sensor stem 25*b* about 12 inches in length to reach rearwardly beyond the front 4-way coupling 26*b* or when installed in either of the side branches 27 or 28 beyond front T-coupling 27*b* or 28*b*, respectively.

Figure 4:
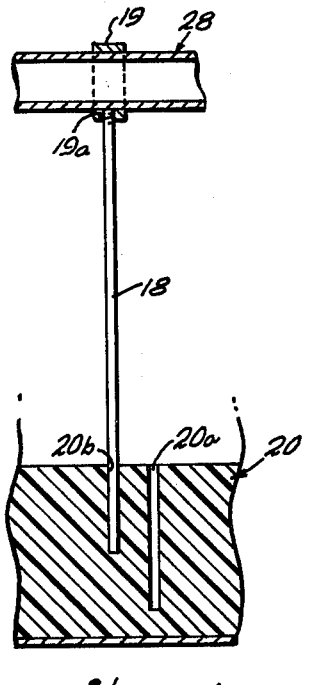
FIG. 4 is a fragmentary sectional view taken on line 4—4 in FIG. 3 showing the holes for adjusting the height of the water spray assembly above the pan bottom.

The illustrated embodiment of the invention contemplates harness 15 being formed as a rigid structure of pipe, couplings, and fittings made of metal with threaded connections or where applicable of tubing with soldered joints, or of comparable plastic components having cemented joints, all in the manner well known to the plumbing art. Where harness 15 is a rigid structure, support thereof in sink 11 at a level determined by the height of front wall 11*d* may be achieved by a plurality of spaced supporting rods 18, each having a threaded upper end engaging a threaded opening 19*a* in a collar 19 which loosely surrounds one of the branches 26, 27 or 28 for sliding longitudinal movement therealong. Rod 18 may be tightened against the underlying conduit in set screw fashion to lock the collar 19 in a desired position along the respective branch. Although six rods 18 are shown for optimum stability and support, namely, one rod 18 located toward the rear and another toward the front of each of the branches 26, 27 and 28, four rods 18 may be used in four corner fashion on the side branches 27 and 28. Any suitable means may be employed at the lower ends of rods 18 for vertically supporting the latter on sink bottom 11*a*, such as, individual bases or suction cups (not shown) or, as shown, an integral base 20 made of wood or plastic and shaped to conform to harness 15 rests on bottom 11*a* and is sized to snugly fit the confines of the vertical walls of sink 11. A series of spaced vertical holes 20*a* of uniform depth are formed in base 20 to selectively and removably seat the lower ends of rods 18. A second series of spaced vertical holes 20*b* may be located adjacent each of the holes 20*a* and be of a different uniform depth, shallower as shown in FIG. 4, whereby relocating rods 18 from one series of holes to another adjusts the level of harness 15 with respect to bottom 11*a*, as well as to the top of front wall 11d and consequently with respect to the patient's legs and feet as hereinafter described.

To facilitate adjusting the position of harness 15 in sink 11 and permit the easy removal thereof, conduit 16 may be a reinforced flexible plastic hose or a flexibel metal pipe, both of standard construction, and may have one or both ends thereof provided with a plug of a quick detachable coupling, also of well known standard construction, for connection to the companion socket mounted on the port of outlet fitting 14 or 4-way coupling 17 or both.

Any suitable drain and connecting means may be utilized, such as, a center drain D provided in bottom 11*a*, for disposal of the water collected in sink 11 through the building sewerage system.

A separate heel rest 30, made of a water resistant material, such as, wood, plastic or the like, and if desired, having a weighted bottom to add stability, is positioned on bottom 11*a*. Although two single heel rests may be used, the double heel rest 30, shown as having a central lower portion cutout 30*a* for accommodating the middle section of base 20, is preferred. The top surface of heel rest 30 may be formed with a pair of cradles 30*b* to locate the patient's heels and improve his comfort.

Mixing valve 13 may be of any standard construction, well known in plumbing, having a single control shaft with push-pull for close-open and intermediate volume flow selection capability and rotation from left for hot to right for cold for temperature selection capability. Mixing valve 13 is mounted on the rear of plumbing panel 12 with the outwardly projecting end of the control shaft terminating in a knob or handle 13*d* which has a pointer 13*e* for aiding in temperature selection by reference to index scale 13*f* provided on a suitable disc attached to plumbing panel 12 behind knob 13*d*.

The nozzles comprising pairs 21, 22, 23 and 24 are also standard plumbing parts, having spray cone size and intensity adjustability and a swivel mount for directional adjustability. Harness 15, by sliding adjustment in collars 19 accomplished when rods 18 are loosened in threaded openings 19*a*, is located so as to direct the spray from nozzle pairs 23 and 24, when the latter are positioned coplanar with and at right angles to supporting branches 26, 27 and 28, to impinge upon the area of the calf indicated in the broken line circle in FIG. 6 when the thighs of a patient having legs of average length rest on front wall 11d. The separation between the centers of T-couplings **27*b* and 28*b* on branches 27 and 28, respectively, and between 4-way couplings 26*b* of middle branch 26 is fixed at about 10 inches to accommodate the average length leg and permit nozzle pairs 21 and 22, when adjusted at a slightly raised angle to the horizontal plane but at right angles to the vertical plane of branches 26, 27 and 28, to direct the spray to impinge upon the area of the foot indicated in the broken line circle in FIG. 6**.

Prior to performing the method and therapy embodying the invention with hydrotherapy apparatus 10, the following preparations are made. The cone size and intensity of the spray from the nozzles are adjusted to deliver a moderate spray having a cone apex of about 50 degrees when mixing valve 13 is opened to a normal operating position in accordance with the water pressure in the supply lines. Nozzle pairs 21, 22, 23 and 24 are adjusted to the positions hereinbefore described for the average size leg. The swivel dial **25*a* on thermometer 25 is adjusted to face upwardly for clear view by the operator when in position to operate mixing valve 13 and observe the patient's legs. Index scale 13*f* is seen to define three broad areas to designate 45° C, 37° C and 21° C which are each subdivided by a plurality of spaced index marks. A calibration of scale 13*f* may be made to determine the precise position of pointer 13*e* with respect to the index marks for each of the three temperatures as a general guide to the operator. The mixing valve 13 is then set at 37° C as indicated by thermometer 25**.

Figure 6:
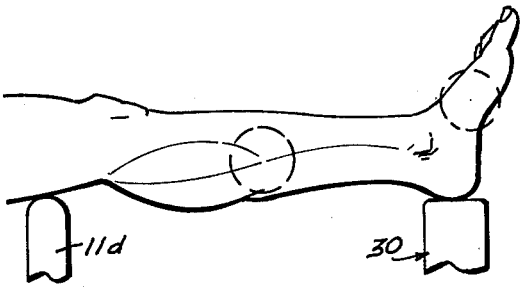
FIG. 6 is a diagrammatic showing of the medial side of the patient's leg shown suspended between the apparatus front wall and the heel rest and indicating in broken line circles the areas of spray impingement.

The patient lies supine on table T which horizontally aligns with the top of front wall **11*d* and is positioned so that his legs extend midway between the branches 26, 27 and 28 as seen in FIG. 2 and with the lower part of the calves defined by the broken line circle in FIG. 6 aligned with nozzle pairs 23 and 24. The thighs rest on front wall 11*d* and the heel rest 30 is adjusted forwardly or rearwardly to precisely accommodate the heels in cradles 30*b*. Nozzle pairs 21 and 22 may now be adjusted to direct the spray to the broken line circle area indicated on the foot in FIG. 6**.

A feature of apparatus 10 is the provision for the patient's body and legs to be supported in a horizontal plane so as to eliminate or neutralize the gravity component or hydrostatic pressure from the venous pressure in the legs and feet during the treatment resulting in a minimum venous pressure against which the smooth muscles of the peripheral veins are required to act.

Figure 5:
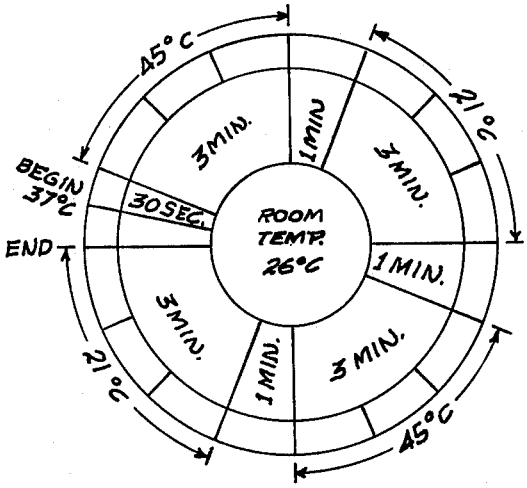
FIG. 5 is a graphic showing of the sequence of time intervals and water temperatures in performing one treatment utilizing the apparatus in FIG. 1 in accordance with the method embodying the invention.

Referring now to FIG. 5, the treatment is performed at a room temperature approximating 26° C for a total duration of 15½ minutes. With the aid of a suitable timer, the operator opens mixing valve 13 to a predetermined level for delivering a spray of desired intensity at the previously set temperature of 37° C. The temperature is then raised by turning the mixing valve knob **13*d* at a rate to reach 45° C, as indicated by thermometer 25**, in ½ minute. This temperature is maintained for 3 minutes and then reduced during a 1 minute change interval to 21° C at which temperature the spray is maintained for 3 minutes to complete one cycle constituting the first half of the treatment. The second cyle constituting the second half of the treatment is seen to be of ½ minute longer duration, requiring 1 minute to return the spray temperature to 45° C for 3 minutes, then a 1 minute change interval to lower the temperature to 21° C where it is maintained for the last 3 minutes of the treatment. The gradual raising or lowering of the temperature during a 1 minute interval prevents indesirable shock to the patient's muscles and nervous system which sudden temperature changes may cause. Likewise, the 3 minute interval during which each temperature is maintained provides sufficient time for the relatively slow acting smooth muscles to completely react and retain the alternate relaxed and contracted states. One treatment may be administered daily or as less frequently as deemed necessary.

Drain D is sized and connected to the building sewerage system to maintain the level of water in sink 11 well below the patient's legs during the treatment. Also, a temperature probe or sensor, suitably positioned in any of the branches 26, 27 or 28 in close proximity to the nozzles and connected to an electronic remote digital display conveniently located, as for example, on plumbing panel 12 may be substituted for thermometer 25 and gauge dial **25*a***.

Should it be desirable, in order to more easily adjust the nozzles to direct the spray at the indicated areas on the calf and foot of a patient, to either raise or lower harness 15 with respect to the fixed level of front wall **11*d* and foot rest 30, this is readily accomplished by changing rods 18 from the holes in base 20 of shallow series 20*b* to deep series 20*a* or vice versa. Likewise, by loosening rods 18 in threaded openings 19*a* of collars 19, harness 15 may be adjusted forwardly or rearwardly to more precisely align nozzle pairs 23 and 24 with the indicated areas on the patient's calf. Harness 15 is then secured on the desired position by tightening the rods 18** for locking against the respective branches.

The hydrotherapy apparatus and method for exercising the smooth muscles in the periperal veins of the leg and foot is seen to achieve the several objects of the invention and to be well adapted to meet conditions of practical use. As various possible embodiments might be made in this invention, and as various changes might be made in the disclosed apparatus and method, it is to be understood that all matter herein set forth and shown in the accompanying drawings are to be interpreted as illustrative and not in a limiting sense.

What is claimed is:

1. A method for exercising the smooth muscles of the veins of the legs and feet comprising the steps of reclining the patient in a supine position wth legs outstretched in horizontal alignment with the body and supported solely above the knees and at the heels, and directing sprays of water against opposite sides of each foot and calf according to a predetermined cycle of times and temperatures including a relatively low temperature for contracting the smooth muscles and a relatively high temperature for relaxing the smooth muscles.

2. The method defined on claim 1 in which said predetermined cycle includes 1 minute intervals for changing the temperature of said sprays by mixing water from hot and cold water sources from one of said temperatures to the other.

3. The method defined in claim 1 in which said predetermined cycle of times and temperatures comprises initially raising the spray temperature from 37° to 45° C, maintaining the 45° C for 3 minutes, lowering the temperature to 21° C during a change interval of 1 minute, maintaining 21° C for 3 minutes, raising the temperature to 45° C during a change interval of 1 minute, maintaining 45° C for 3 minutes, lowering the temperature to 21° C during a final change interval of 1 minute and maintaining the temperature at 21° C for a final 3 minutes.

4. An apparatus for exercising the smooth muscles of the veins of the legs and feet comprising a water collecting pan connected to a drain facility, a horizontal surface for a patient to lie on in a supine relaxed position with legs outstretched and extending horizontally over said pan, rest surface means associated with said pan for supporting each leg in said outstretched horizontal position by contacting the underside of each thigh and heel, each leg otherwise being freely suspended between the thigh and heel, eight spray nozzles, each connected to a water conduit, supported and located to simultaneously direct sprays of water to predetermined areas on opposite sides of each of said suspended feet and calves, means for sensing the temperature within the water conduit and displaying same, means connecting said water conduit to hot and cold water sources through an interposed manually operable mixing valve, and means for supporting said mixing valve in accessible relation to said pan for convenient manipulation by an operator while viewing the patient's legs and observing said temperature display means.

5. The apparatus defined in claim 4 in which said water conduit and spray nozzles are formed as a water spray assembly comprising three parallel, coplanar, uniformly spaced branches which emanate from a 4-way coupling, right and left branches of said assembly each having a pair of spaced T-couplings, each mounting one of said spray nozzles at right angles to the respective branch, the middle branch having a pair of 4-way couplings aligned with said T-couplings, each mounting a pair of oppositely facing spray nozzles, each of which coact with the nozzle on the adjacent branch as a nozzle pair directing sprays to one of said predetermined areas on the opposite sides of said calves or feet.

6. The apparatus defined in claim 5 in which one of said branches terminates at a closed end beyond said T-coupling or 4-way coupling in said temperature display means and has said sensing means projecting from the display means through and along the branch to the region of one of its nozzles.

7. The apparatus defined in claim 5 in which said water collecting pan is sink-like and has vertical side, rear and front walls, said front wall being of predetermined height above a bottom, the latter having an area for accommodating said water spray assembly, means providing said support and location for said water spray assembly including a base resting on said bottom, a plurality of collars mounted on said side branches, and support rods interconnecting said collars with said base.

8. The apparatus defined in claim 7 in which said rest surface means comprises the top of said front wall as the thigh support and a block resting on said bottom as the heel support, said block being movable forwardly and rearwardly on said bottom to adjust to the length of a patient's legs.

9. The apparatus defined in claim 8 in which said support rods and base are constructed and arranged to locate said water spray assembly a predetermined distance above the top of said front wall to align with the patient's legs, the connection of said support rods with said base being a series of holes of predetermined depth in which the lower ends of said support rods seat.

10. The apparatus defined in claim 7 in which said collars are sized to permit relative sliding movement of said branches therethrough for adjusting said water spray assembly forwardly or rearwardly with respect to said front wall, and set screw means for locking said collars in an adjusted position.

11. The apparatus defined in claim 5 in which said water collecting pan is sink-like and has vertical side, rear and front walls, a plumbing panel extending above said rear wall on which said mixing valve is mounted with a manual operating knob extending therefrom for said accessibility, an outlet fitting mounted on said panel connected to the output of said mixing valve, a flexible pipe interconnecting said outlet fitting with said first mentioned 4-way coupling, and a quick detachable coupling associated with said flexible pipe to disconnect said water spray assembly from said panel.

* * * * *